United States Patent [19]

Konosu et al.

[11] Patent Number: 4,728,915

[45] Date of Patent: Mar. 1, 1988

[54] DEFLECTION YOKE FOR A COLOR CATHODE RAY TUBE

[75] Inventors: Osamu Konosu, Nagaokakyo; Katsuyo Iwasaki, Nishinomiya, both of Japan

[73] Assignee: Matsushita Electronics Corporation, Kadoma, Japan

[21] Appl. No.: 27,190

[22] Filed: Mar. 17, 1987

[30] Foreign Application Priority Data

Mar. 18, 1986 [JP] Japan ..... 61-59948
Apr. 7, 1986 [JP] Japan ..... 61-79757

[51] Int. Cl.[4] ..... H01F 3/12
[52] U.S. Cl. ..... 335/211; 335/214
[58] Field of Search ..... 335/210, 214, 213, 212; 313/427, 428, 431

[56] References Cited

U.S. PATENT DOCUMENTS

| | | | |
|---|---|---|---|
| 3,772,554 | 11/1973 | Hughes | 313/412 |
| 4,307,363 | 12/1981 | McGlashan | 335/211 |
| 4,335,366 | 6/1982 | Alig et al. | 335/214 |
| 4,433,268 | 2/1984 | Arisato | 313/440 |
| 4,600,858 | 7/1986 | Iwasaki et al. | 313/413 |
| 4,636,684 | 1/1987 | Yokota et al. | 335/214 X |

FOREIGN PATENT DOCUMENTS

| | | | |
|---|---|---|---|
| 58-109513 | 1/1985 | Japan | 335/210 |

*Primary Examiner*—George Harris
*Attorney, Agent, or Firm*—Cushman, Darby & Cushman

[57] ABSTRACT

A pair of magnetic member for collecting leakage magnetic flux of barrel-shaped vertical deflection magnetical flux to produce an auxiliary vertical deflection magnetic field of pin-cushion type around the neck of a cathode ray tube at the part of the electron gun, wherein each magnetic member has a vertical principal face part which is to face in parallel to a vertical principal face part of the other magnetic member with regard to a vertical axis of the CRT, and a pair of bar-shaped member, that is an upper horizontal bars and a lower horizontal bars connected to the upper edge part and the lower edge part of the principal plane part and extending toward the neck of the cathode ray tube; the provision of the above-mentioned magnetic members on a deflection yoke of a color cathode ray tube decreases convergence coma and coma distortion of beam spots, and is suitable for producing color picture image with good color convergence, in especially large face wide deflection type color cathode ray tube.

14 Claims, 13 Drawing Figures

DEFLECTION YOKE FOR A COLOR CATHODE RAY TUBE

FIELD OF THE INVENTION AND RELATED ART STATEMENT

1. Field of the Invention

This invention relates to an improvement in a color deflection yoke for producing a pin-cushion shape horizontal deflection magnetic field and barrel-shape vertical deflection magnetic field.

2. Description of the Related Art

In general, a deflection yoke to be mounted on a color cathode ray tube has a saddle type horizontal deflection coil and a toroidal type vertical deflection coil. The horizontal deflection coil generates, as shown in FIG. 1, a horizontal deflection magnetic field having a considerable pin-cushion type distorted component, and the vertical deflection coil generates, as shown in FIG. 2, a vertical deflection magnetic field having a considerable barrel type distorted component, thereby to constitute a self-convergence system which does not require a dynamic convergence circuit. the above-mentioned conventional coil has a problem of being liable to produce, so called, convergence coma, that a green raster produced by an electron beam passing the center part of the deflection field makes miss-registration against red raster and blue raster produced by electron beams passing both side parts of the deflection field, as shown in FIG. 3. Furthermore, as shown in FIG. 4, there is a liability of producing a rotary distortions for the beam spots r and b made by the electron beams at both sides. These distortions can not be negligible, especially in a large type or wide deflection angle type color cathode ray tube apparatus or in a pin-cushion-less type apparatus, wherein raster distortions at the left side and right side of the picture screen are corrected by adjustment of magnetic field distribution; the above-mentioned undesirable distortions are related to becoming barrel type distribution of vertical deflection magnetic field, especially at the electron gun side; and especially, such problem becomes prominent in an apparatus wherein tendency of barrel type distortion is increased at the electron gun side as a result of distortion of the vertical deflection magnetic field of the phosphor screen side to pin-cushion type distribution as shown in FIG. 5.

OBJECT AND SUMMARY OF THE INVENTION

The present invention purposes to provide a deflection yoke which can produce a color raster of low convergence coma and low coma distortions of beam spots without loss of horizontal deflection efficiency by using a magnetic members of a simple configuration.

The object of the invention is accomplished by a deflection yoke for a color cathode ray tube comprising pair of a first magnetic member and a second magnetic member for producing a pin-cushion-shaped auxiliary vertical deflection magnetic field by collecting leakage of vertical magnetic flux which generally has a tendency of barrel-shaped magnetic field distribution; wherein each of the first magnetic member and the second magnetic member has a principal plane part which faces a principal plane part of the other one in symmetry with regard to a vertical center plane which including the tube axis and has an upper bar and a lower bar which are horizontally projected from an upper part and a lower part, respectively, of the principal plane part to the vicinity of the vertical center plane and bent in the vicinity of outer face of tube neck of said cathode ray tube to extend toward electron gun side along the outer face.

As a result of the above-mentioned configuration, the principal face parts of the pair of the magnetic members serves to collect leakage flux of the vertical deflection magnetic field, and the upper bars and the lower bars extending therefrom serves to form an auxiliary vertical deflection magnetic field of pin-cushion shape. Accordingly, the conventional convergence coma and coma distortion of beam spots can be decreased without necessity of providing small magnetic pieces called enhancer-shunt which is disclosed in the U.S. Pat. No. 3,772,554.

DESCRIPTION OF THE PREFERRED EMBODIMENTS

Figure 6:
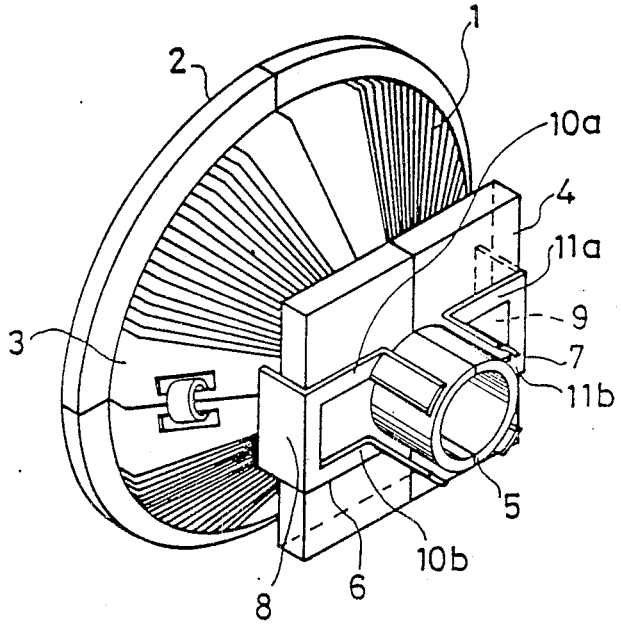
FIG. 6 is a perspective view showing a deflection yoke embodying the present invention.

A first embodiment of the present invention is elucidated with reference to FIG. 6 which is a perspective view of a deflection yoke embodying the present invention. An insulation frame 2 of a synthetic resin, which supports toroidal type vertical deflection coil 1 and further holds a horizontal deflection coil of saddle type (not shown in the figure) inside thereof, and further has a cone part 3 for attachment to a cone part of the color picture tube, a box-shaped part 4 which contains parts of the coils therein and a tube-shaped part 5 for passing therethrough a neck part of a color picture tube comprising in-line type electron guns. And on both outside face of the box-shaped part 4, a first principal plane part 8 and a second principal part 9 of a first magnetic member 6 and a second magnetic member 7, respectively, are fixed in a manner to face each other in symmetry with regard to a vertical plane including axis of the color picture tube. Each principal face part 8 or 9 has, at its upper edge and at its lower edge an upper horizontal bar 10*a* or 11*a* and a lower horizontal bar 10*b* or 11*b* extending therefrom, respectively; and end parts of the upper horizontal bar 10*a* or 11*a* and the lower horizontal bar 10*b* or 11*b* are bent towards the side of electron gun, namely to axial direction. The box-shaped part 4 contains arc-shaped parts of electron gun side of the horizontal deflection coil. The magnetic members 6 and 7 has a construction symmetry with regard to the vertical central plane including the tube axis thereon, and with regard to the central horizontal plane including the tube axis thereon.

Figure 7:
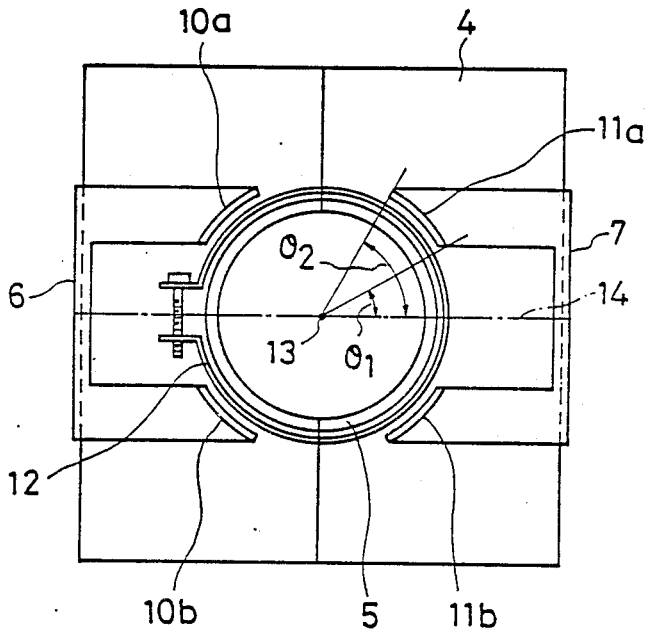
FIG. 7 is a backside view showing configuration of the deflection yoke of FIG. 6.

When seen from the backside (from the side of the electron gun), as shown in FIG. 7, the bent parts 10*a*, 10*b*, 11*a* and 11*b* are formed so as to have sections of arc-shape, which are on a circle coaxial with the outer face of the tube-shaped part 5, and each have a predetermined gap from the surface of the tube-shaped part 5. A tying band 12 for fixing the insulation frame 2 onto the neck part of the color picture tube is positioned inside the arc-shaped bent part and on the tube shaped part 5. Each one of bent parts of the upper bars 10*a*, 11*a* and lower bars 10*b*, 11*b* lies in an angular position around the tube axis 13 from the central horizontal plane in a range from angle $\theta_1$ to angle $\theta_2$ as shown in FIG. 7. The angle $\theta_1$ should be selected larger than 20° and preferably is 35°±10°, and $\theta_2$ should be between 45° and 90° and preferably is 85°±3°.

Figure 1:
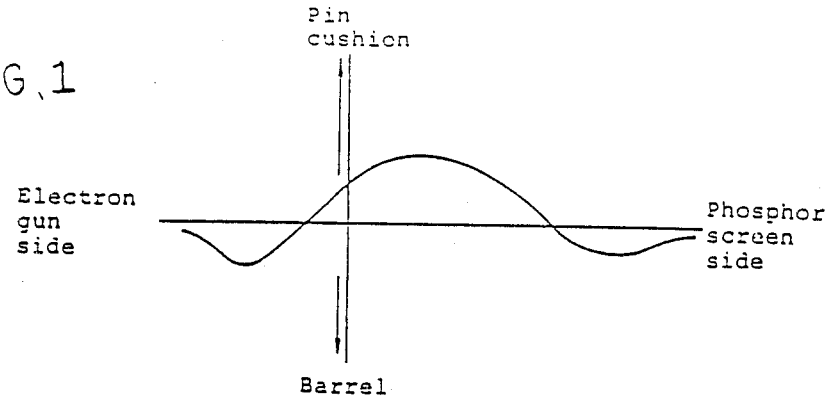
FIG. 1 is the graph showing the relation between the pin-cushion distortion in horizontal deflection magnetic field and axial position of the cathode ray tube.
Figure 2:
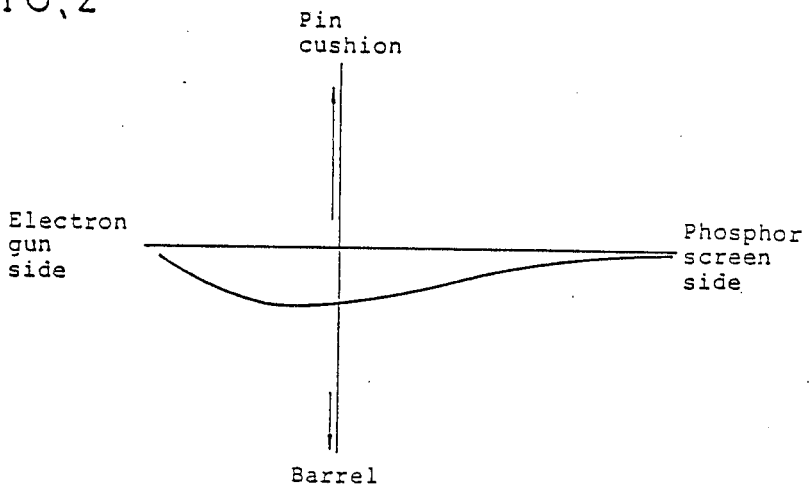
FIG. 2 is the graph showing the relation between the pin-cushion distortion of the vertical deflection magnetic field and the axial position of the cathode ray tube.
Figure 3:
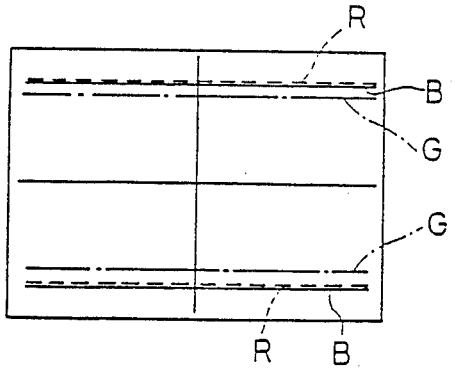
FIG. 3 is the drawing for illustrating convergence coma to be produced by the conventional deflection yoke.
Figure 4:
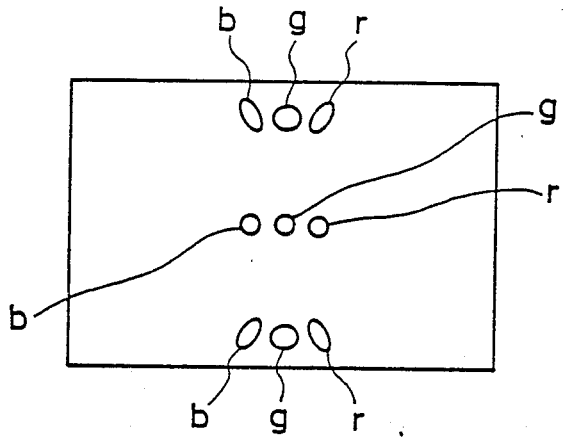
FIG. 4 is the drawing for illustrating coma distortion of beam spots.
Figure 5:
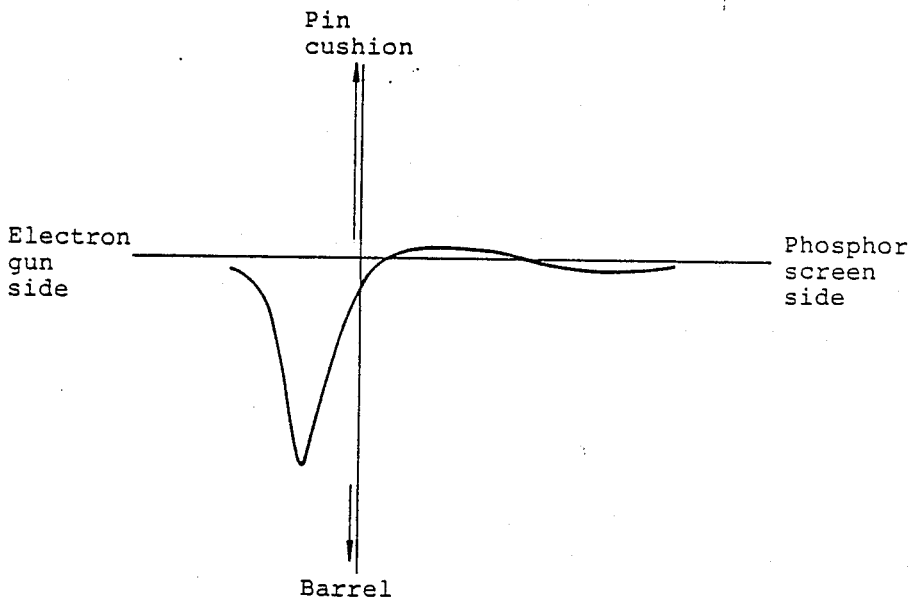
FIG. 5 is the graph showing the relation between the pin-cushion distortion of the conventional vertical deflection magnetic field made by the conventional yoke and axial position of the cathode ray tube.
Figure 8:
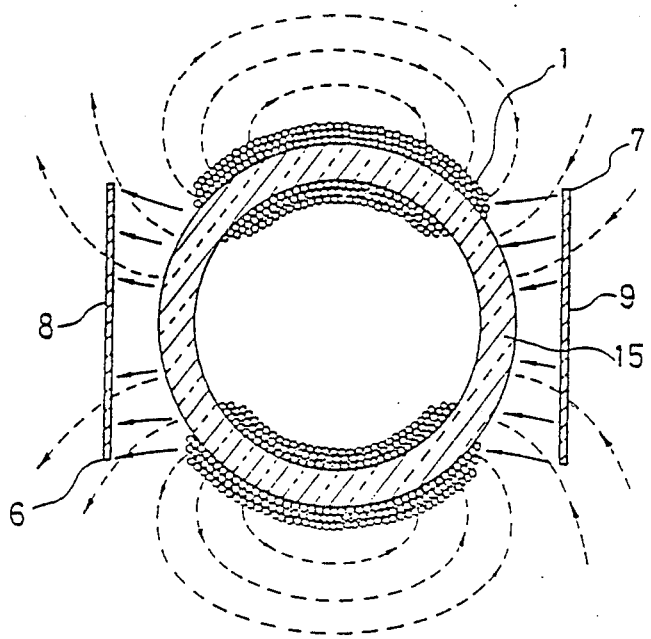
FIG. 8 and FIG. 9 are figures showing operation of the deflection yoke.
Figure 9:
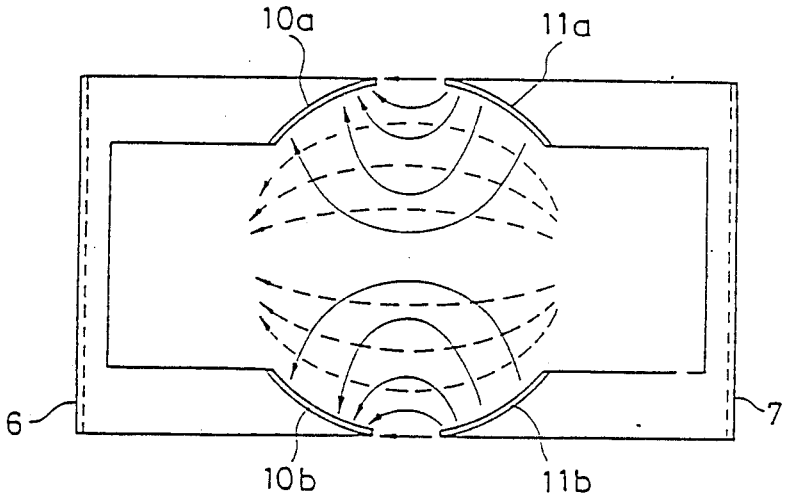

The vertical deflection coil 1, as a whole, produces a vertical deflection magnetic field which is distorted as shown in FIG. 2 generally in barrel type tendency, and the horizontal coil produces a horizontal deflection magnetic field which is distorted generally in pin-cushion shape tendency as shown in FIG. 1. As shown in FIG. 8, the vertical deflection magnetic field leaks out of the core 15, and the leakage magnetic field is collected by the principal face parts 8 and 9 of the magnetic member 6 and 7, and therefore an auxiliary vertical deflection magnetic field of a distribution of pin-cushion shape as shown by solid line arrows in FIG. 9 are generated by four bars 10*a*, 10*b*, 11*a* and 11*b* at the electron gun region.

Besides the example of FIGS. 6 and 7, the vertical principal plane parts 8 and 9 can be of curved faces, for instance, partial arc-shaped sheet disposed coaxialy with the tubular part 15, or any other shape. Further, the bent parts 10*a*, 10*b*, 11*a* and 11*b* may have straight sectional shape besides the arc-shaped section shown in FIG. 6 and FIG. 7.

By configurating as above, the barrel-shape-distributed vertical deflection magnetic field is transformed into pin-cushion shape distribution at the electron gun side, and thereby the convergence coma and coma distortion of beam spots can be decreased easily and simply, and further the degree of adjustment or transforming to the pin-cushion shape distribution can be made desirably by selecting length of the upper and lower bars and bent parts thereof and by selecting the angles $\theta_1$ and $\theta_2$ appropriately.

In the below-mentioned second embodiment, lowering of horizontal deflection efficiency due to collection of some parts of the horizontal deflection magnetic field at the electron gun side by the magnetic members can be improved. That is, in the second embodiment of FIG. 10, front side upper bars 16*a* and 17*a* are provided at the upper front edges of the vertical principal face parts 8 and 9, and lower front side bars 16*b* and 17*b* are provided at the lower front edge parts of the vertical principal face part 8 and 9, respectively, in substantial parallelism to the rear side bars 10*a*, 11*a*, 10*b* and 11*b*. Thereby, undesirable lowering of the horizontal deflection efficiency due to interaction of the horizontal deflection magnetic field to the magnetic member at the electron gun side can be removed.

Further by provisions of the protrusion 81 and 91, besides the provisions of the front side upper bars 16*a*, 17*a* and front side lower bars 16*b*, 17*b*, the horizontal deflection efficiency is further increased.

Figure 10:
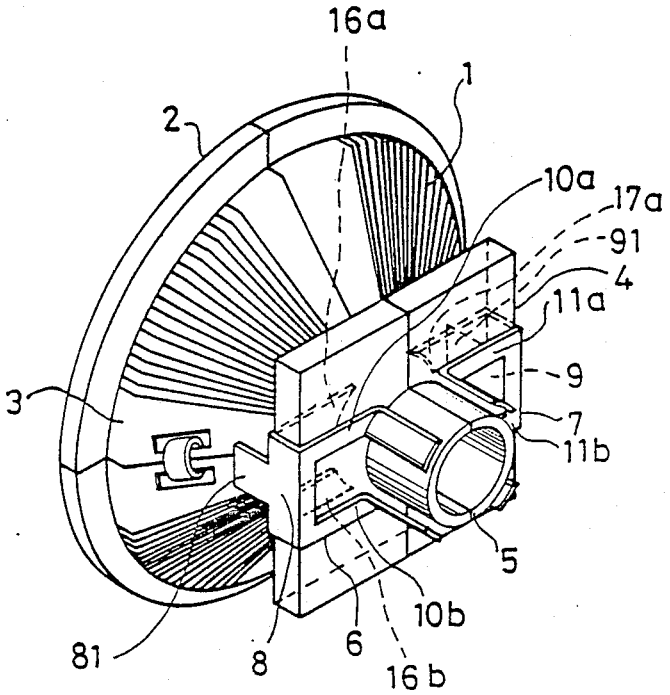
FIG. 10 is a perspective view showing a deflection yoke of another embodiment.
Figure 11:
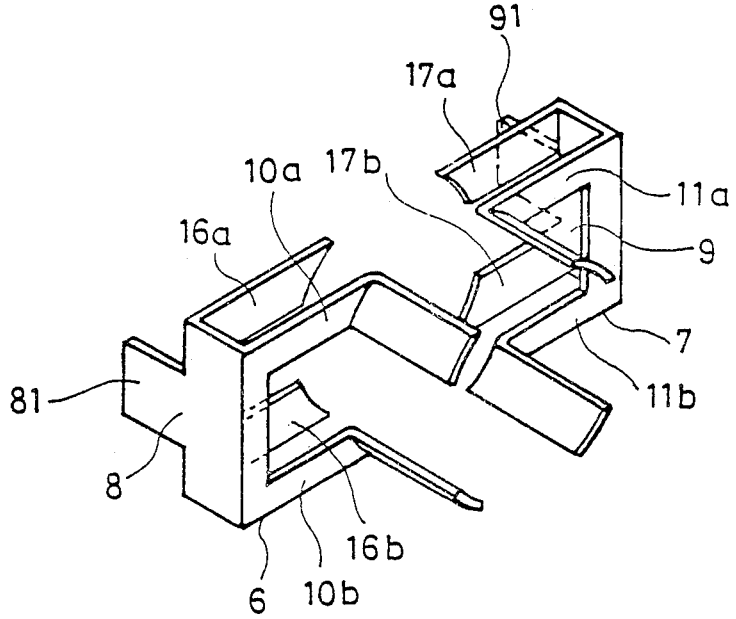
FIG. 11 is a perspective view showing magnetic members of the deflection yoke of the embodiment of FIG. 10.
Figure 12:
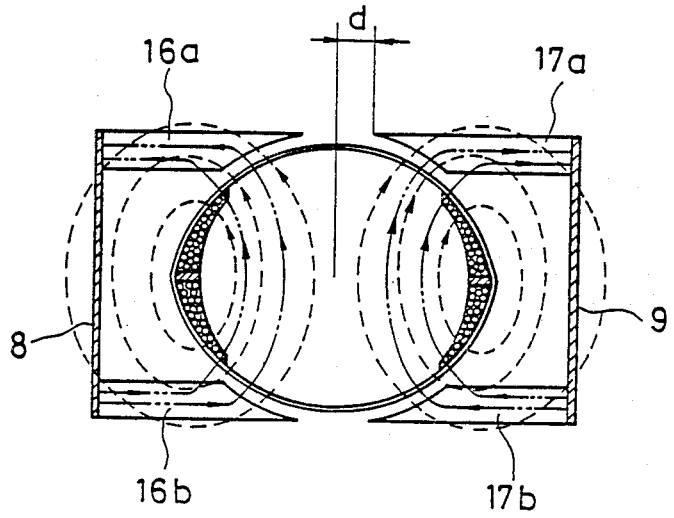
FIG. 12 is a figure showing operations of the above-mentioned embodiments.

Details of the second embodiment is elucidated with reference to FIGS. 10, 11 and 12. A difference is obvious from a comparison between FIG. 6 and FIG. 10, the second embodiment is characterized by provisions of the front side upper bars 16*a* and 17*a* and the front side lower bars 16*b* and 17*b* besides the configuration of FIG. 6. The front side upper and lower bars 16*a*, 17*a* are provided at the edge of upper front side (phosphor screen side) of the vertical principal plane parts 8 and 9, respectively, in a manner to embrace the upper part of the box-shaped part 4 together with the vertical principal plane parts 8 and 9 and the upper bars 10*a*, 11*a* provided at the rear (electron gun side) upper edges of the vertical principal plane parts 8 and 9, respectively; the front side lower bars 16*b*, 17*b* are provided at the lower front side edge of the vertical principal plane parts 8 and 9, respectively, in a manner to embrace the upper part of the box-shaped part 4 together with the vertical principal plane parts 8 and 9 and the lower bars 10*b*, 11*b* provided at the rear lower edges of the vertical principal plane parts 8 and 9, respectively.

As shown in FIG. 8, the vertical deflection coil 1 generally produces a vertical deflection magnetic field which is generally distorted to barrel-shape tendency, and the horizontal deflection coil generates a horizontal deflection magnetic field which is generally distorted to pin-cushion shape tendency. And a part of the vertical deflection magnetic field produces leakage flux shown by broken arrow lines in FIG. 8, and this leakage flux is collected by the vertical principal faces 8 and 9 of the magnetic members 6 and 7, respectively, and an auxiliary vertical deflection magnetic field of pin-cushion shape distribution shown by solid line curves in FIG. 9 is produced by means of the upper bars and lower bars 10*a*, 10*b*, 11*a* and 11*b* in the electron gun side region.

The front side upper bars and lower bars 16*a*, 16*b*, 17*a* and 17*b* serves as yokes for the horizontal deflection magnetic field as shown in FIG. 12, and the horizontal deflection magnetic field is strengthened. That is, an auxiliary horizontal deflection magnetic field of pin-cushion shape distribution is produced in the electron gun side region, and thus undesirable lowering of horizontal deflection efficiency can be effectively suppressed by the provisions of the magnetic members.

Figure 13:
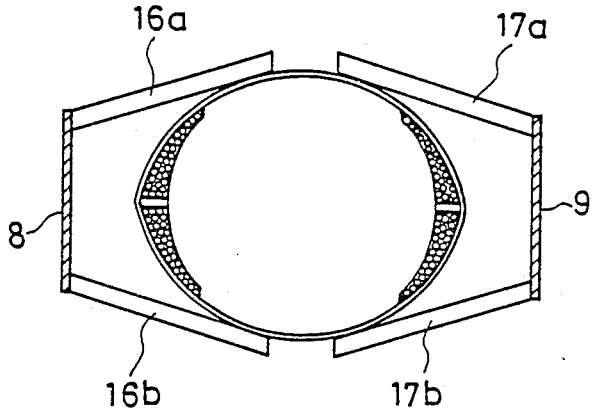
FIG. 13 is a cross-sectional view of another example embodying the present invention.

Adjustment of the horizontal deflection efficiency can be made by selections of sizes of the upper horizontal bars and lower horizontal bars 16*a*, 16*b*, 17*a* and 17*b* appropriately. The gap distance 2*d* between the left side bar and the right side bar may be at least above 0, and for instance, 4 mm is preferable. In the embodiment shown in FIG. 13, the upper bars 16*a* and 17*a* and lower bars 16*b* and 17*b* are not disposed horizontal, but disposed inclined. Such configuration also makes good result. Furthermore, a modification can be made such that the upper bars and lower bars are inserted in the box-shaped part 4.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A deflection apparatus for a color cathode ray tube comprising:

(a) a pair of horizontal deflection coils for producing a horizontal magnetic field having generally pin-cushion shape distortion, (b) a pair of vertical deflection coils for producing a vertical magnetic field having generally barrel shape distortion, (c) an insulation bobbin having a cone shape part which is to be disposed on narrower end part of a cone part of a cathode ray tube, said cone shape part holding said horizontal deflection coils and said vertical deflection coils thereon and having a tubular part wherein a neck part of said cathode ray tube is to be disposed, and (d) a pair of magnetic members for producing a pin-cushion-shaped auxiliary vertical deflection magnetic field by collecting leakage of vertical magnetic flux which generally has a tendency of barrel-shaped magnetic field distribution, wherein each of said pairs of magnetic members has a substantially vertical principal plane part which faces a vertical principal plane part of the other one in symmetry with each other with regard to a vertical center plane which includes the axis of said color cathode ray tube, and has an upper bar and a lower bar which are substantially horizontally projected from an upper part and a lower part, respectively, of said principal plane part to the vicinity of the vertical center plane and are bent in a vicinity of an outer face of said tubular part to extend in the axial direction toward electron gun side along the outer face.

2. A deflection apparatus for a color cathode ray tube in accordance with claim 1, wherein bent parts of said bars are disposed in an angular position around said axis in a range of above 20°–45° from the central horizontal plane including the tube axis.

3. A deflection apparatus for a color cathode ray tube in accordance with claim 1, wherein said pair of magnetic member is disposed in symmetry with a central vertical plane including said axis.

4. A deflection apparatus for a color cathode ray tube in accordance with claim 1, wherein said pair of magnetic member is disposed in symmetry with a central horizontal plane including said axis.

5. A deflection apparatus for a color cathode ray tube in accordance with claim 1, wherein said insulation bobbin comprises a box-shaped part between said cone-shape part and said tubular part, for containing therein arc shaped parts at electron gun side of said horizontal deflection coils, and said principal plane parts of said magnetic members are abutted on side faces of said box-shaped part.

6. A deflection apparatus for a color cathode ray tube in accordance with claim 1, wherein bent part of said bars have cross-sections of shape of arcs, which arc are disposed on a circle which has its axis on said axis.

7. A deflection apparatus for a color cathode ray tube comprising:

(a) a pair of horizontal deflection coils for producing a horizontal magnetic field having generally pin-cushion shape distortion, (b) a pair of vertical deflection coils for producing a vertical magnetic field having generally barrel shape distortion, (c) an insulation bobbin having a cone shape part which is to be disposed on narrower end part of a cone part of a cathode ray tube, said cone shape part holding said horizontal deflection coils and said vertical deflection coils thereon and having a tubular part wherein a neck part of said cathode ray tube is to be disposed, and (d) a pair of magnetic members for producing a pin-cushion-shaped auxiliary vertical deflection magnetic field by collecting respective leakages of said horizontal deflection magnetic flux and said vertical magnetic flux, wherein each of said pair of magnetic members has a substantially vertical principal plane part which faces a vertical principal plane part of the other one in symmetry to each other with regard to a vertical center plane which includes the axis of said color cathode ray tube, and has an upper rear side bar and a lower rear side bar which are substantially horizontally projected from an upper rear part and a lower rear part, respectively, of said principal plane part to the vicinity of the vertical center plane and are bent in a vicinity of an outer face of said tubular part to extend in the axial direction toward electron gun side along the outer face to produce an auxiliary vertical deflection magnetic field of pin-cushion transformation and has an upper front side bar and a lower front side bar which are substantially horizontally projected from an upper front part and a lower part, respectively, of said principal plane part to the vicinity of the vertical center plane to produce an auxiliary horizontal deflection magnetic field of pin-cushion transformation.

8. A deflection apparatus for a color cathode ray tube in accordance with claim 7, wherein bent parts of said bars are disposed in an angular position around said axis in a range of above 20°–45° from the central horizontal plane including the tube axis.

9. A deflection apparatus for a color cathode ray tube in accordance with claim 7, wherein said pair of magnetic member is disposed in symmetry with a central vertical plane including said axis.

10. A deflection apparatus for a color cathode ray tube in accordance with claim 7, wherein said pair of magnetic member is disposed in symmetry with a central horizontal plane including said axis.

11. A deflection apparatus for a color cathode ray tube in accordance with claim 7, wherein said insulation bobbin comprises a box-shaped part between said cone-shape part and said tubular part, for containing therein arc shaped parts at electron gun side of said horizontal deflection coils, and said principal plane parts of said magnetic members are abutted o side faces of said box-shaped part.

12. A deflection apparatus for a color cathode ray tube in accordance with claim 7, wherein bent part of said bars have cross-section of shape of arcs, which arc are disposed on a circle which has its axis on said axis.

13. A deflection apparatus for a color cathode ray tube in accordance with claim 7, wherein each of said principal plane part has a protrusion which protrudes to front side beyond said upper front side bar and lower front side bar.

14. A deflection apparatus for a color cathode ray tube in accordance with claim 7, wherein said bars of symmetric pair are disposed in a manner that gap between the upper bars and the lower bars increases with distance from the principal plane part from which they project.

* * * * *